US012702235B2

(12) United States Patent
Clausen

(10) Patent No.: US 12,702,235 B2
(45) Date of Patent: Aug. 11, 2026

(54) INFLATABLE BACKREST

(71) Applicant: Bruce Clausen, Apple Valley, MN (US)

(72) Inventor: Bruce Clausen, Apple Valley, MN (US)

( * ) Notice: Subject to any disclaimer, the term of this patent is extended or adjusted under 35 U.S.C. 154(b) by 273 days.

(21) Appl. No.: 18/640,769

(22) Filed: Apr. 19, 2024

(65) Prior Publication Data

US 2024/0374039 A1 Nov. 14, 2024

Related U.S. Application Data

(60) Provisional application No. 63/501,328, filed on May 10, 2023.

(51) Int. Cl.

| | |
|---|---|
| ***A47C 15/00*** | (2006.01) |
| ***A47C 7/40*** | (2006.01) |
| ***A47C 7/42*** | (2006.01) |
| ***B63B 34/52*** | (2020.01) |

(52) U.S. Cl.

CPC ..... *A47C 15/006* (2013.01); *A47C 7/407* (2013.01); *A47C 7/42* (2013.01); *B63B 34/52* (2020.02)

(58) Field of Classification Search

CPC ..... B63B 34/52; A47C 15/006; A47C 7/405; A47C 7/42

See application file for complete search history.

(56) References Cited

U.S. PATENT DOCUMENTS 2,804,123 A * 8/1957 Kling ..... A63G 23/00 297/313
3,769,647 A * 11/1973 Basa ..... B63B 34/50 441/38
3,860,976 A * 1/1975 Suyama ..... B63B 34/52 441/35
D287,528 S 12/1986 Maxwell et al.
4,687,452 A * 8/1987 Hull ..... B63B 34/565 297/250.1
5,292,175 A * 3/1994 Artz ..... B60N 2/2881 297/452.41
5,334,067 A * 8/1994 Henry ..... B63B 34/565 441/131
5,476,404 A * 12/1995 Price ..... A47C 15/006 441/131
5,688,153 A * 11/1997 Yeung ..... B63B 34/52 441/132
D393,683 S 4/1998 Song et al.

(Continued)

FOREIGN PATENT DOCUMENTS

CN 203543728 U * 4/2014
EP 0350236 B1 * 4/1992 ..... A47D 13/08
GB 2108435 A * 5/1983 ..... A47C 15/006

*Primary Examiner* — Marc Q Jimenez
*Assistant Examiner* — Jovon E Hayes
(74) *Attorney, Agent, or Firm* — Allison Johnson, P.A.

(57) ABSTRACT

An inflatable backrest that includes an inflatable body of an inflatable backrest, the inflatable body including a base, a first major front facing surface and a second major back facing surface, an apron fixedly attached to the inflatable body, the apron extending away from the major front facing surface of the inflatable body and extending away from the second major back facing surface of the inflatable body, and a strap attached to at least one of the base of the inflatable body and the apron, the strap having a first end and a second end.

21 Claims, 9 Drawing Sheets

(56) References Cited

U.S. PATENT DOCUMENTS

| | | | | |
|---|---|---|---|---|
| 6,227,925 | B1 * | 5/2001 | Boddy | B63B 34/52<br>441/129 |
| 6,491,558 | B1 * | 12/2002 | Myers | B63B 34/52<br>441/130 |
| 2007/0204406 | A1 * | 9/2007 | Thisse | A47C 7/0213<br>5/655.3 |

* cited by examiner

INFLATABLE BACKREST

BACKGROUND

The invention is directed to an inflatable backrest.

Sitting in the center of an inflatable inner tube and floating on a lake or down a river is a fun pastime enjoyed by many people. However, sitting for extended periods of time can place a strain on the back, neck, and head of a user.

There are number of inflatable tubes available for use in floating on a body of water. Some of these tubes include a backrest permanently attached to the tube such that removing the backrest would puncture or damage the tube or the backrest.

There is a need for an inflatable backrest that can be attached to and removed from an inflatable tube without damaging the tube or the backrest.

SUMMARY

In one aspect, the invention features an inflatable backrest that includes an inflatable body of an inflatable backrest, the inflatable body comprising a base, a first major front facing surface and a second major back facing surface; an apron fixedly attached to the inflatable body, the apron extending away from the major front facing surface of the inflatable body and extending away from the second major back facing surface of the inflatable body; and a first strap attached to at least one of the base of the inflatable body and the apron, the strap having a first end and a second end. In one embodiment, the inflatable backrest further includes a mating connector comprising a female connector and a male connector, one of the male connector and the female connector coupled to the strap, and the other of the male connector and the female connector coupled to the strap, the apron, or a combination thereof.

In another embodiment, one of the male connector and the female connector is moveable relative to the first strap, and the other of the male connector and the female connector is fixedly attached to the first strap, the apron, or a combination thereof.

In some embodiments, one of the male connector and the female connector is moveably coupled to the first strap, and the other of the male connector and the female connector is fixedly attached to the apron.

In one embodiment, the first strap includes rubber selected from the group consisting of butyl rubber, halogenated butyl rubber, and combinations thereof. In another embodiment, the strap includes thermoplastic polymer, elastomer, rubber, polymer-impregnated woven webs, multiple layers, or a combination. In some embodiments, the first strap includes polyvinyl impregnated woven web, polyurethane impregnated woven web, thermoplastic resin-impregnated woven web, elastomer-impregnated woven web, rubber-impregnated woven web, or a combination thereof.

In other embodiments, the first end of the first strap is fixedly attached to the apron.

In another embodiment, the first end of the first strap is fixedly attached to the inflatable body near the base of the inflatable body.

In some embodiments, the apron is fixedly attached to the inflatable body near the base of the inflatable body.

In one embodiment, the apron defines a shape selected from the group consisting of an arcuate shape, a linear shape, a v shape and combinations thereof.

In some embodiments, the first strap has a longitudinal extent and includes a securing strap that has longitudinal extent, the securing strap being fixedly attached to the second end of the first strap such that the longitudinal extent of the securing strap is oriented perpendicular to the longitudinal extent of the first strap.

In other embodiments, the securing strap includes a rubber selected from the group consisting of butyl rubber, halogenated butyl rubber, and combinations thereof.

In one embodiment, the inflatable backrest further includes a pouch attached to at least one of the inflatable body and the apron. In some embodiments, the pouch is attached to the second major back facing surface of the inflatable body. In one embodiment, the pouch is dimensioned to store the inflatable body when the inflatable body is in a deflated state.

In another embodiment, the backrest further includes a second strap, the first strap being fixedly attached to a portion of the apron extending from the first major front facing surface of the inflatable body and the second strap being fixedly attached to a portion of the apron extending from the first major back facing surface of the inflatable body.

In another aspect, the invention features an inflatable recreational device that includes a toroidal-shaped tube defining an interior hole and having a tube circumference, and an inflatable backrest disclosed herein secured to the tube, the strap extending around the tube diameter and being fastened to the at least one of the base of the inflatable body and the apron to secure the inflatable backrest to the tube. In one embodiment, the toroidal-shaped tube includes a rubber inner tube. In other embodiments, the toroidal-shaped tube includes a rubber ring torus.

Other features and advantages will be apparent from the following brief description of the drawings, description of the preferred embodiments, and from the claims.

GLOSSARY

Figure 1:
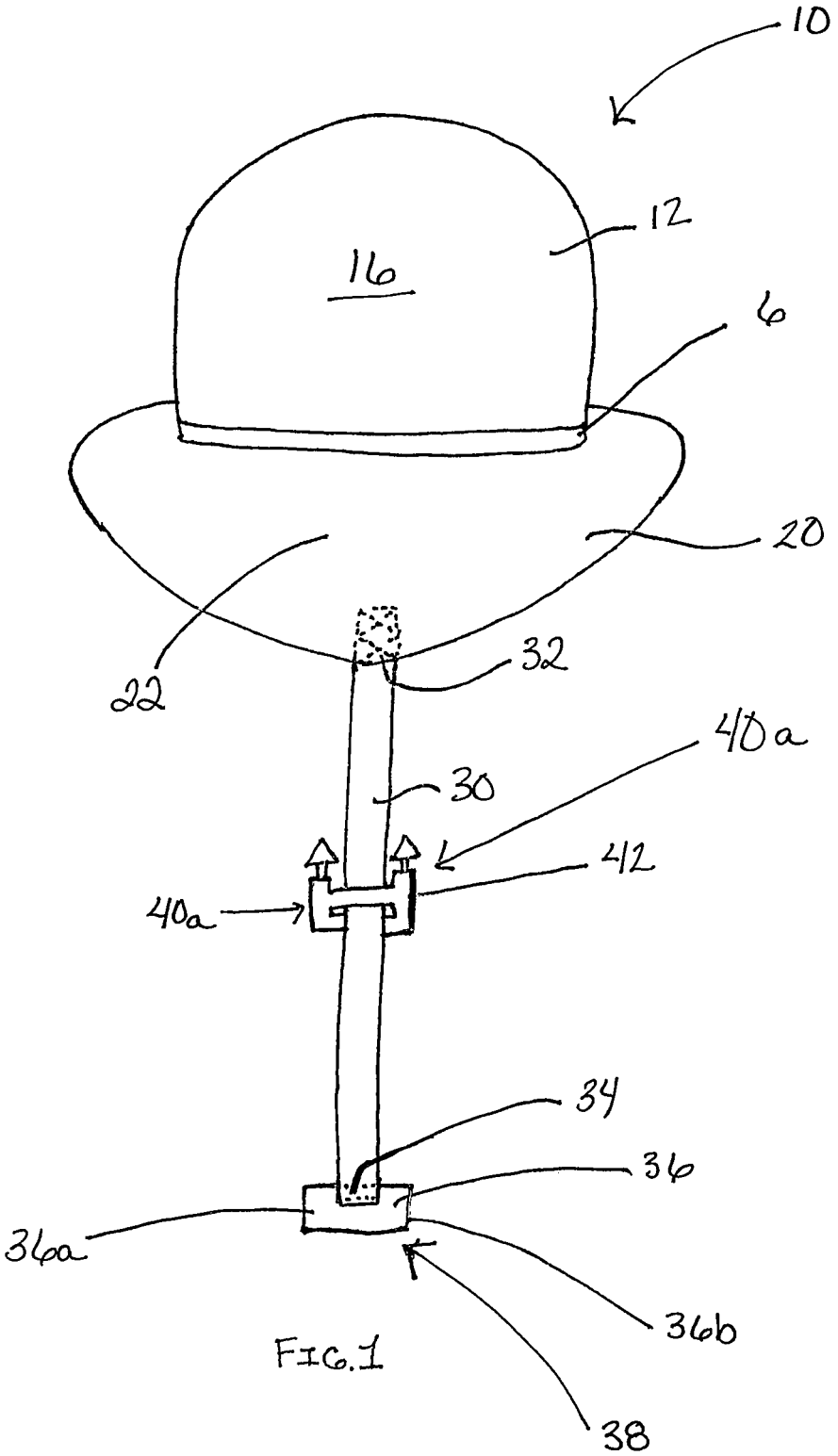
FIG. 1 is a front plan view of the inflatable backrest.
Figure 2:
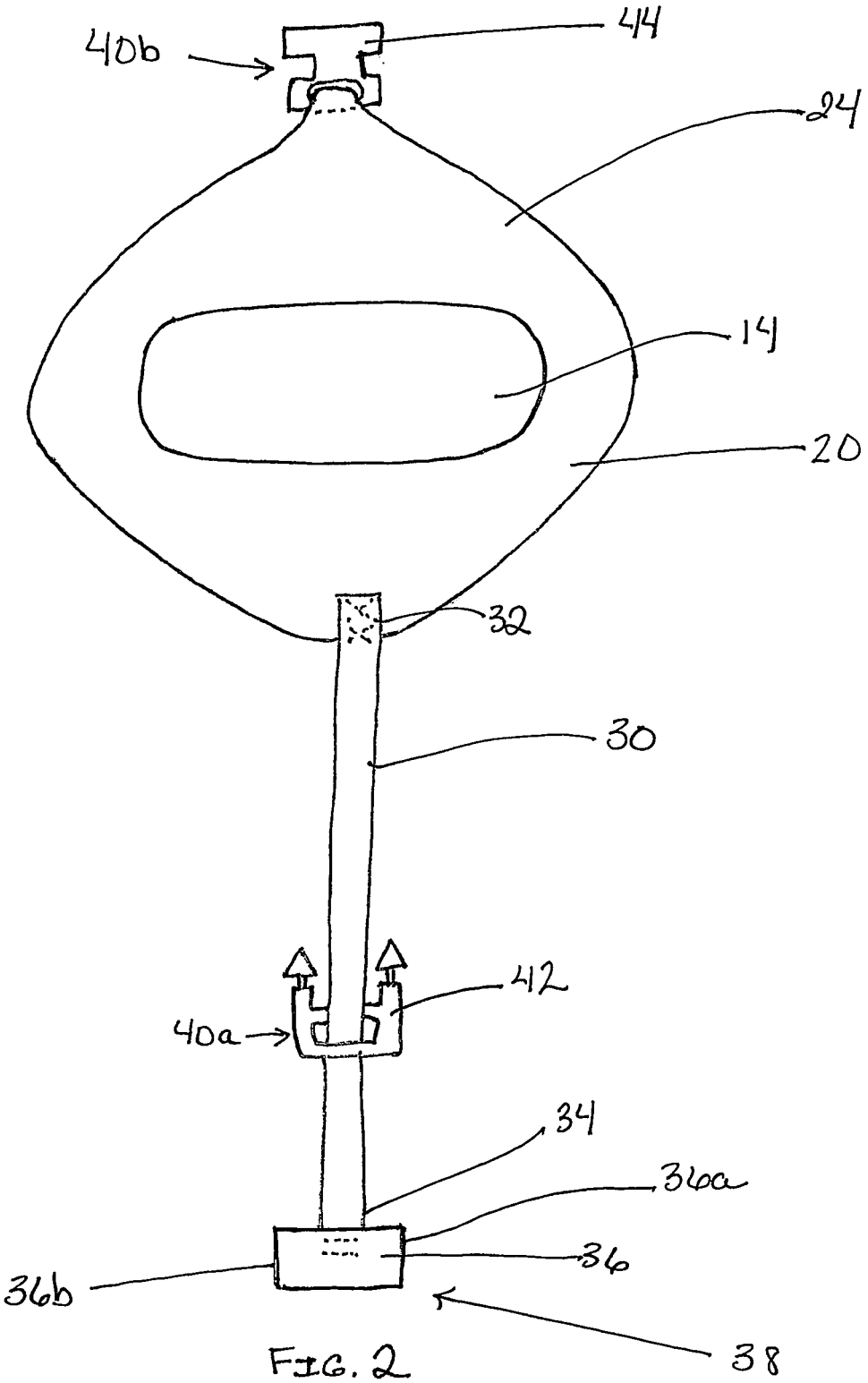
FIG. 2 is a bottom plan view of the inflatable backrest of FIG. 1.
Figure 3:
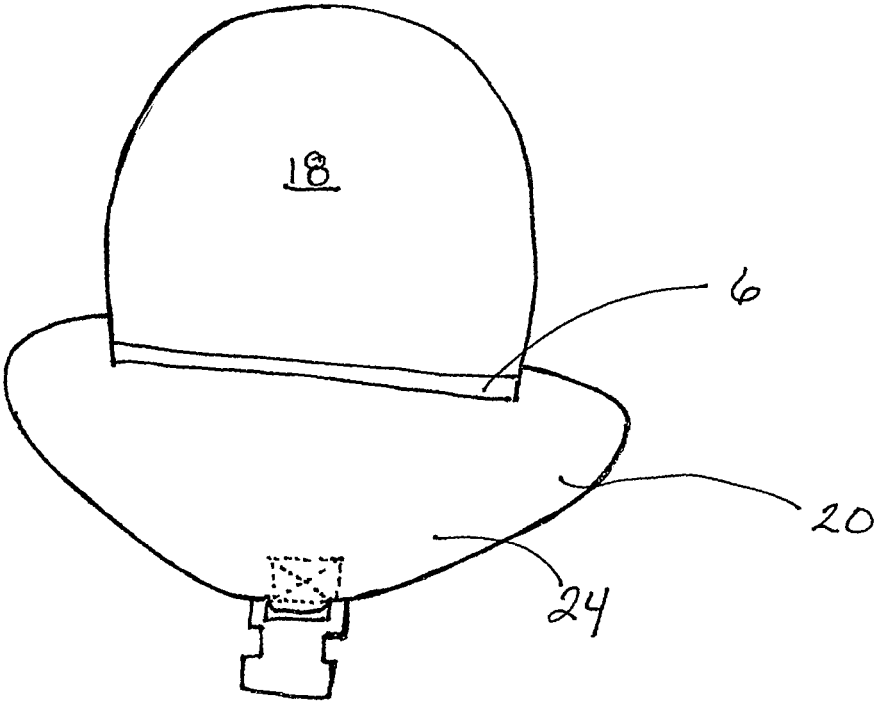
FIG. 3 is a back plan view of the inflatable backrest of FIG. 1.

In reference to the invention, these terms have the meanings set forth below:

The term "backrest" means an article against which a portion of the back, neck or head of a human being can rest while seated.

DETAILED DESCRIPTION

The inflatable backrest includes an inflatable body that includes a base, a first major front facing surface and a second major back facing surface, an apron fixedly attached to the inflatable body, the apron extending away from the major front facing surface of the inflatable body and extending away from the major back facing surface of the inflatable body, and at least one strap attached to the base of the inflatable body, the apron, or a combination thereof, the strap having a first end and a second end.

In one embodiment, the inflatable backrest 10 includes an inflatable body 12 that includes a base 14, a first major front facing surface 16, a second major back facing surface 18, an apron 20 fixedly attached to the inflatable body 12 through a weld 6, and a scalable inflation port (not shown), as shown in FIGS. 1-3 and 5. The apron 20 includes a front facing portion 22 that extends away from the major front facing surface 16 of the inflatable body 12 and a back facing portion 24 that extends away from the major back facing surface 18 of the inflatable body 12. A first end 32 of a strap 30 is fixedly attached to the front facing portion 22 of the apron 20 and a second end 34 of the strap 30 is attached to a strap securing member 36 (e.g., a fixing strap also referred to herein as a securing strap). A female connector component 44 of a male-female connector 40*a*, 40*b* is attached to a back facing portion 24 of the apron 20 and a male connector component 42 of the male-female connector 40*a*, 40*b* is moveably attached to the strap 30. The male connector component 42 of the male-female connector 40 can be moved into position as desired along the longitudinal extent (i.e., length) of the strap 30 and fixed in position at the desired position on the strap 30. A useful position along the length of the strap 30 is one that maintains the strap 30 taught and in a fixed position around a circumference of a floatable recreational device (e.g., a tire inner tube) when the male connector component 42 and the female connector component 44 are locked in position with one another. The strap 30 includes a strap securing member 36 for securing the free end 38 of the strap 30 in a fixed position when the strap 30 is attached to a floatable recreational device. The ends 36*a*, 36*b* of the strap securing member 36 can be folded around the strap 30 towards each other in an overlapping configuration. The composition of the material from which the strap 30 and the strap securing member 36 are made can assist in holding the strap 30 and the free end 38 of the strap 30 in a fixed relation to the floatable recreational device when positioned on the device, e.g., when encircling a rubber innertube.

Although the body is depicted as exhibiting a generally arcuate shape, it may be of a variety of shapes including, e.g., circular, elliptical, polygonal (e.g., triangular, square, rectangular, pentagonal, hexagonal, heptagonal, octagonal, nonagonal, decagonal, hendecagonal, dodecagonal, tridecagonal, and icosagonal), rhombohedral, frustoconical, and combinations thereof. In some embodiments, the body, and optionally the body in combination with the apron, straps, or a combination thereof, defines a shape including, e.g., the shape of an animal (e.g., a horned animal, a rhinoceros, a water buffalo, a buffalo, a giraffe, a lion, a bear, a wolf, a cat, a dog, a cow, a pig, a horse, a bird, a parrot, a duck, a pelican, a flamingo, a penguin, an ostrich, an owl, a jelly fish, a fish, a snail, and combinations thereof), a cartoon character, a super hero (e.g., a caped super hero), a portion of such a shape (e.g., an appendage (e.g., a paw), an upper body portion (e.g., a head, torso, and combinations thereof), and combinations thereof), and combinations thereof.

Although the apron is depicted as exhibiting a generally arcuate shape, it may be of a variety of shapes including, e.g., circular, elliptical, polygonal (e.g., triangular, square, rectangular, pentagonal, hexagonal, heptagonal, octagonal, nonagonal, decagonal, hendecagonal, dodecagonal, tridecagonal, and icosagonal), rhombohedral, frustoconical, and combinations thereof. The back facing portion and the front facing portion of the apron can exhibit the same or different shape.

The apron and the body can be made from the same or different material. The apron and the body can be made from a variety of suitable materials including, e.g., thermoplastic polymer (e.g., polyvinyl chloride, polyolefin (e.g., polypropylene, polyethylene, polyester, and combinations thereof), elastomer (e.g., styrenic block copolymers), rubber (e.g., butyl rubber, halogenated rubber and combinations thereof), air impervious and scalable textiles (e.g., woven webs (e.g., woven fabrics), nonwoven webs, and knitted webs) including, e.g., polymer-impregnated textiles (including, e.g., polyvinyl chloride impregnated woven webs, polyurethane impregnated woven webs, thermoplastic resin-impregnated woven webs, elastomer-impregnated woven webs, rubber-impregnated woven webs, and combinations thereof, multilayer materials including, e.g., polyvinyl chloride-polyester woven web-polyvinyl chloride multilayer webs, and combinations thereof.

Useful textiles are made from a variety of materials including, e.g., nylon, polyolefin (e.g., polyethylene and polypropylene), polyvinyl chloride, polyester, cotton, and combinations thereof.

The strap(s) are of suitable dimensions and construction to ensure that, when the inflatable backrest is secured in position on an inflatable device such as an inner tube, the force and tension exerted by the strap on the apron and the inflatable body of the backrest (e.g., the force of a person leaning against the body of the backrest), pulls with a more uniform force on the apron and thereby enables the inflatable body to be maintained in a generally fixed configuration without being rotated outward away from the center of the inflatable device (e.g., the center hole defined by an inner tube), sideways (e.g., along the circumference of an inner tube), or inward toward the center of the inflatable device (e.g., the center hole defined by an inner tube). Useful straps include a longitudinal extent, a width that is less than the longitudinal extent, and a thickness that preferably is less than the width. The strap preferably is flat and includes one layer and optionally includes at least two layers (e.g., a laminate of two different materials).

The strap can be of any suitable dimensions including, e.g., having a longitudinal extent sufficient to extend around the circumference of a floatable recreational device (e.g., an inner tube) on which the backrest is to be positioned and to secure the backrest to the floatable recreational device, and a lateral extent sufficient to provide sufficient strength to the strap and enable the backrest to be secured to the floatable recreational device in a fixed position. Examples of useful lateral extents include from 1 cm to 250 cm, from 3 cm to 250 cm, or even from 5 cm to 225 cm.

The strap can be made from a variety of materials including, e.g., rubber (e.g., butyl rubber, halogenated rubber and combinations thereof), elastomer (e.g., styrenic block copolymers, polyolefins, and combinations thereof), thermoplastic polymer (e.g., nylon, synthetic aramid (e.g., KEVLAR), polyolefins (e.g., polypropylene), and combinations thereof), thermoset polymer, textile (e.g., woven fabrics), and combinations thereof. The strap can be of a variety of constructions including, e.g., rope (e.g., twisted rope braided rope, and paracord), treated woven fabrics (e.g., saturated woven fabrics, coated woven fabrics (e.g., continuously coated, discontinuously coated (e.g., stripes of coating, dots of coating, and combinations thereof), and combinations thereof), and combinations) where the fabric is treated on one or more sides thereof with elastomer, rubber, thermoplastic polymer, thermoset polymer, and combinations thereof, and combinations thereof. The strap can also be of a single layer or multilayer construction including, e.g., a laminate of nylon and rubber. Particularly useful strap materials include rubber (e.g., butyl rubber, halogenated rubber, and combinations thereof). Useful commercially available straps are available under a variety of trade designations including, e.g., the trade designation "simple strap" from Simple Strap LLC (Honolulu, Hawaii).

Although the connectors of the backrest have been depicted as being male-female connectors, any suitable connectors can be used including, e.g., mechanical fasteners including, e.g., snaps, buckles, turn fastener, twist lock fastener, and combinations thereof. In some embodiments, the backrest does not include a connector and instead includes openings, preferably reinforced with grommets, through which the strap(s) can pass. The connector can be made from a variety of materials including, e.g., plastic (e.g., polyolefin (e.g., polypropylene, polyethylene, and combinations thereof), polyester, polyacrylate, and combinations thereof), metal, elastomer, rubber, and combinations thereof.

The various components of the backrest (e.g., the body, the apron, the strap, and the connectors) can be attached to each other through a variety of attachment mechanisms including, e.g., welds (e.g., thermal welds and sonic welds), adhesive compositions, stitching, stapling, mechanical fasteners including, e.g., grommets, snaps, buckles, and male-female connectors), and combinations thereof.

The backrest is particularly useful as a backrest for a floatable recreational device such as a floatable toroidal tube, e.g., a ring torus (e.g., inflatable rubber tubes, flexible inflatable rubber tubes, and rubber inner tubes (e.g., flexible inflatable rubber tubes in the shape of a doughnut and designed to be positioned in a rubber tire)). The backrest can be removably secured in a relatively fixed position (preferably a fixed position) on a floatable recreational device and positioned so as to enable a user of the device to relax the back side (e.g., torso, neck, head, or a combination thereof) against the backrest.

Referring to FIGS. 6-11, an embodiment of a floatable recreational device 400 that includes an inner tube 410 (e.g., an inflatable inner tube), a backrest 10 positioned on the inner tube 410, and a strap 30, is shown. A first end 32 of the strap 30 is fixedly attached to the bottom surface of a front facing portion 22 of an apron 20 of the backrest 10. The unattached end 38 of the strap 30 extends around the circumference 412 of the inner tube 410. The male connector component (not shown) is coupled to the female connector component 44, the free end 38 of the strap 30 is pulled taught so as to place tension on the strap 30 and to maintain the backrest 10 in a fixed or relatively fixed position on the inner tube 410, and the ends of the securing strap 36 are folded around the width of the strap 30 toward the inner tube 410 to secure the end 38 of the strap against the inner tube 410.

Useful toroidal tubes include inflatable tubes. Toroidal tubes can be made from a variety of suitable materials including, e.g., rubber (e.g., butyl rubber, halogenated rubber and combinations thereof), elastomer (e.g., styrenic block copolymers), thermoplastic polymer (e.g., polyvinyl chloride and polyolefin), polymer-impregnated woven webs including, e.g., polyvinyl impregnated woven webs, polyurethane impregnated woven webs, thermoplastic resin-impregnated woven webs, elastomer-impregnated woven webs, rubber-impregnated woven webs, and combinations thereof), and combinations thereof. The woven webs can be made from a variety of materials including, e.g., nylon, polyethylene, polyester, and combinations thereof.

In some embodiments, the flotation device is made from materials or sheets of materials that are capable of being bonded to each other through welding, e.g., thermal welding and sonic welding, through adhesive compositions, and combinations thereof.

In some embodiments, the body of the inflatable backrest and the flotation device are of a construction that includes a polymer bladder enveloped in a cover, e.g., a woven web, a coated woven web, a polymer-impregnated woven web, and combinations thereof.

Other embodiments are within the claims. Although the floatation device has been described as inflatable, any component of the floatation device could be made from any buoyant or floatable material including, e.g., closed cell foam, wood, and combinations thereof.

Although the female connector has been depicted as being attached to the back portion of the apron, in other embodiments the female connector is positioned at and attached to any one of a variety of locations including, e.g., moveably attached to the strap, fixedly attached to the front portion of the apron, and combinations thereof. The corresponding male connector would be positioned and removably or fixedly attached as necessary to form a mating connecting between the components of the male-female connector.

Although the male connector has been depicted as being moveably attached to the strap, in other embodiments the male connector is positioned at and attached to any one of a variety of locations including, e.g., fixedly attached to the front facing portion of the apron, fixedly attached to the back facing portion of the apron, and combinations thereof. The corresponding female connector would be positioned and removably or fixedly attached as necessary to form a mating connecting between the components of the male-female connector.

Figure 12:
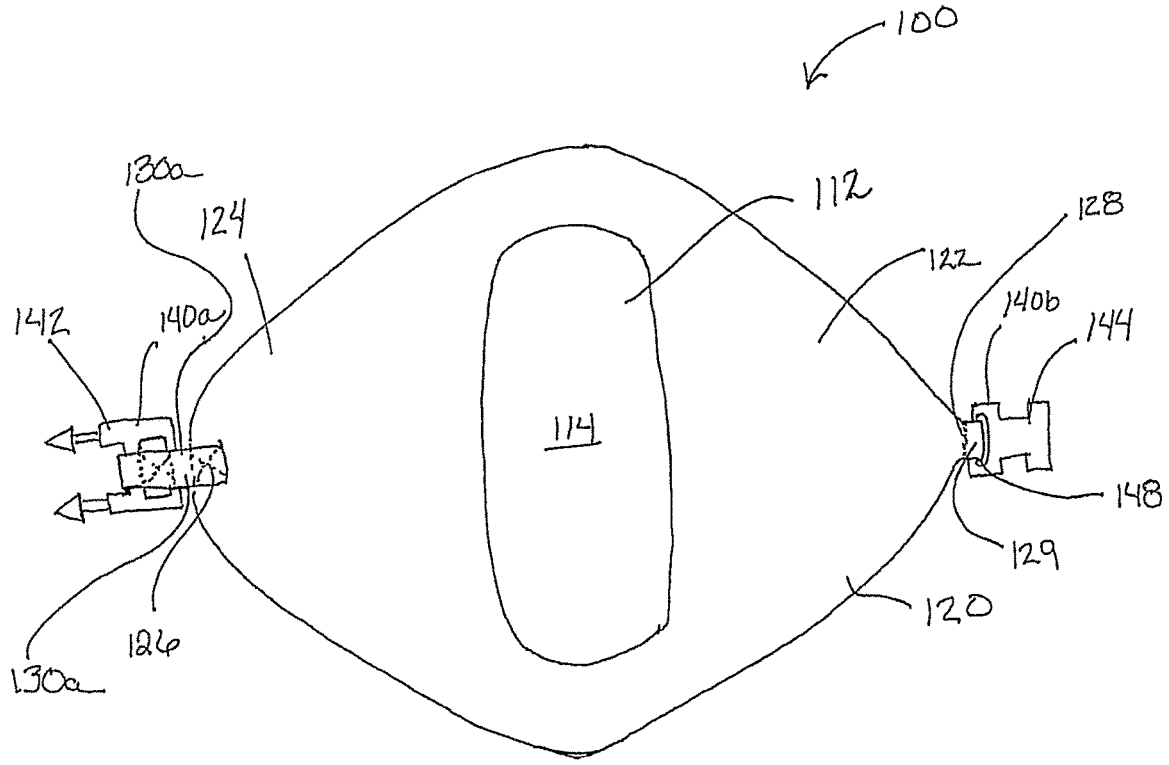
FIG. 12 is a bottom view of an inflatable backrest according to another embodiment.
Figure 14:
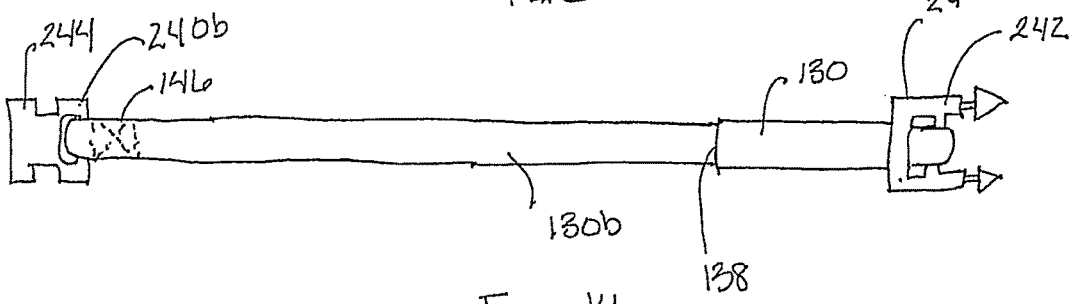
FIG. 14 is a top plan view of a strap that is attachable to the inflatable backrest of FIG. 12.
Figure 13:
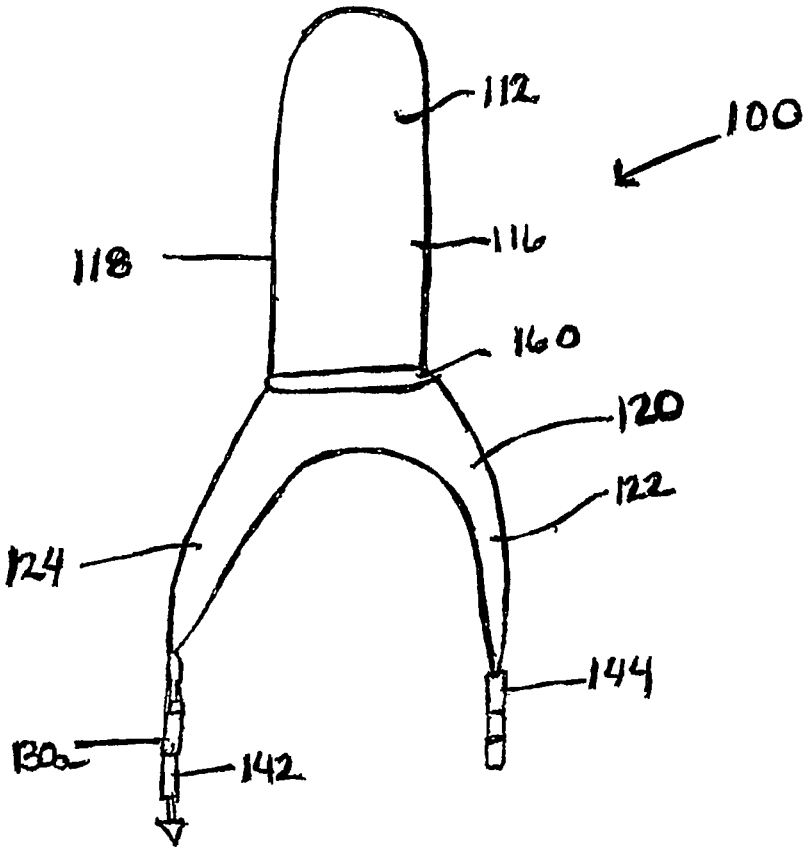
FIG. 13 is a right side view of the inflatable backrest of FIG. 12.

In some embodiments, one of the male and female connectors of a first male-female connector is fixedly attached to the back facing portion of the apron, another of the male and female connectors of the first male-female connector is fixedly attached to the front facing portion of the apron, and the strap includes a corresponding male connector and a female connector of a second male-female connector attached to the strap and configured to connect to the first male-female connector. Referring to FIGS. 12-14, an embodiment of an inflatable backrest 100 that includes an inflatable body 112 that includes a base 114, front facing portion 118, and a back facing portion 116, an apron 120 welded to the body 112 at the weld line 160, a male connector 142 of a first male-female connector 140*a*, 140*b* fixedly attached to the front facing portion 124 of the apron 120 through a first strap 130*a*, which is fixedly attached to the apron 120 through stitching 126, and a female connector 144 of the first male-female connector 140 fixedly attached to the back facing portion 122 of the apron 120, is shown. A portion 129 of the back facing portion 122 of the apron 120 extends through an opening 148 in the female connector 144 and is fixedly secured in position through stitching 128.

Referring to FIG. 14, a second strap 130*b*, which includes a male connector component 242 of a second male-female connector 240*a*, 240*b* moveably attached to the strap 130, and a female connector component 244 of the second male-female connector 240*a*, 240*b* fixedly attached to the strap 130*b*. The second strap 130*b* is available for attachment to the backrest 100 through the first and second male-female connectors 140, 240 by securing the first and second male-female connectors 140, 240 to each other (e.g., first male connector component 142 matingly attaches to second female connector component 244 and second male connector component 242 matingly attaches to first female connector component 144) and cinching the free end 138 of the second strap 130*b*.

Figure 15:
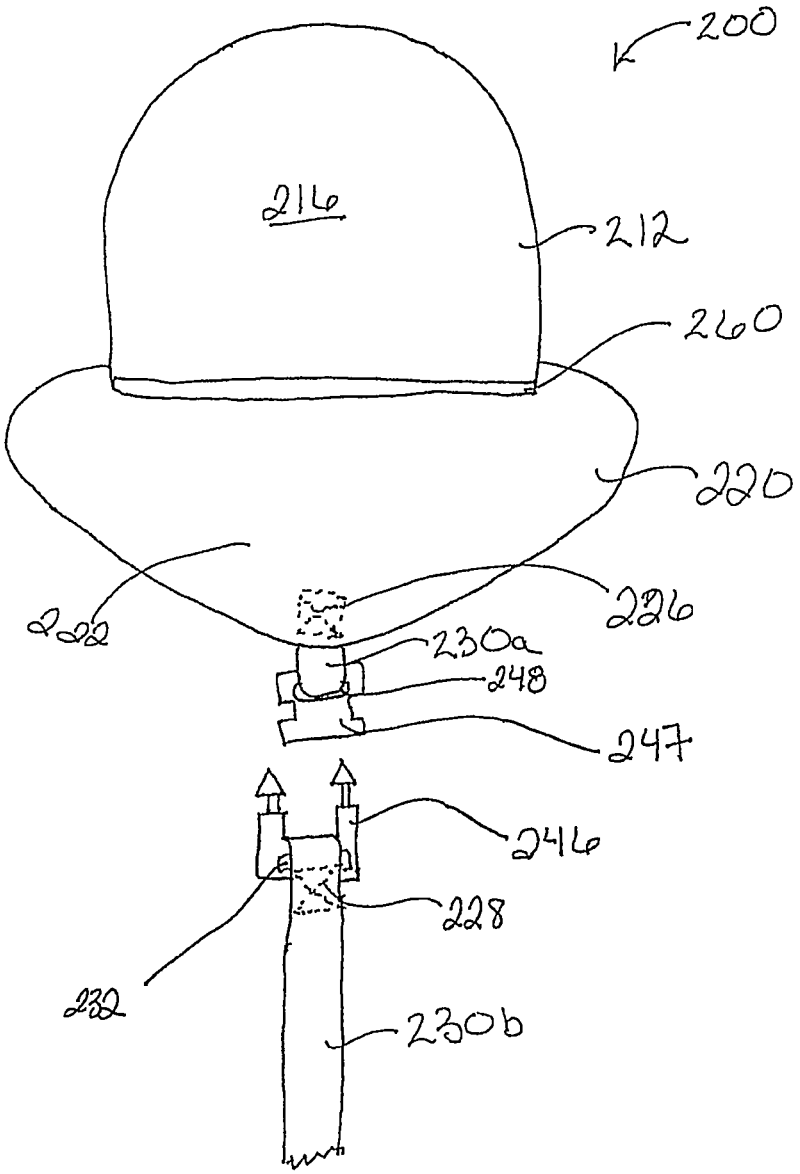
FIG. 15 is a front plan view of an inflatable backrest according to another embodiment.

Referring to FIG. 15, another embodiment of a backrest 200 is shown. The backrest 200 includes an inflatable a body 212 that includes a major front facing surface 216, an apron 220 attached to the inflatable body 212 through a weld 260, a first strap 230*a* that extends through an opening 248 in the female connector component 247 and is fixedly attached to the bottom surface of the front facing portion 222 of the apron 220 through stitching 226, and a second strap 230*b* that includes a first end that extends through an opening 232 in a male connector component 246 positioned on the length of the second strap 230*b* and is fixed in position through stitching 228. The male connector component 246 is available for connection with the female connector component 247.

Figure 16:
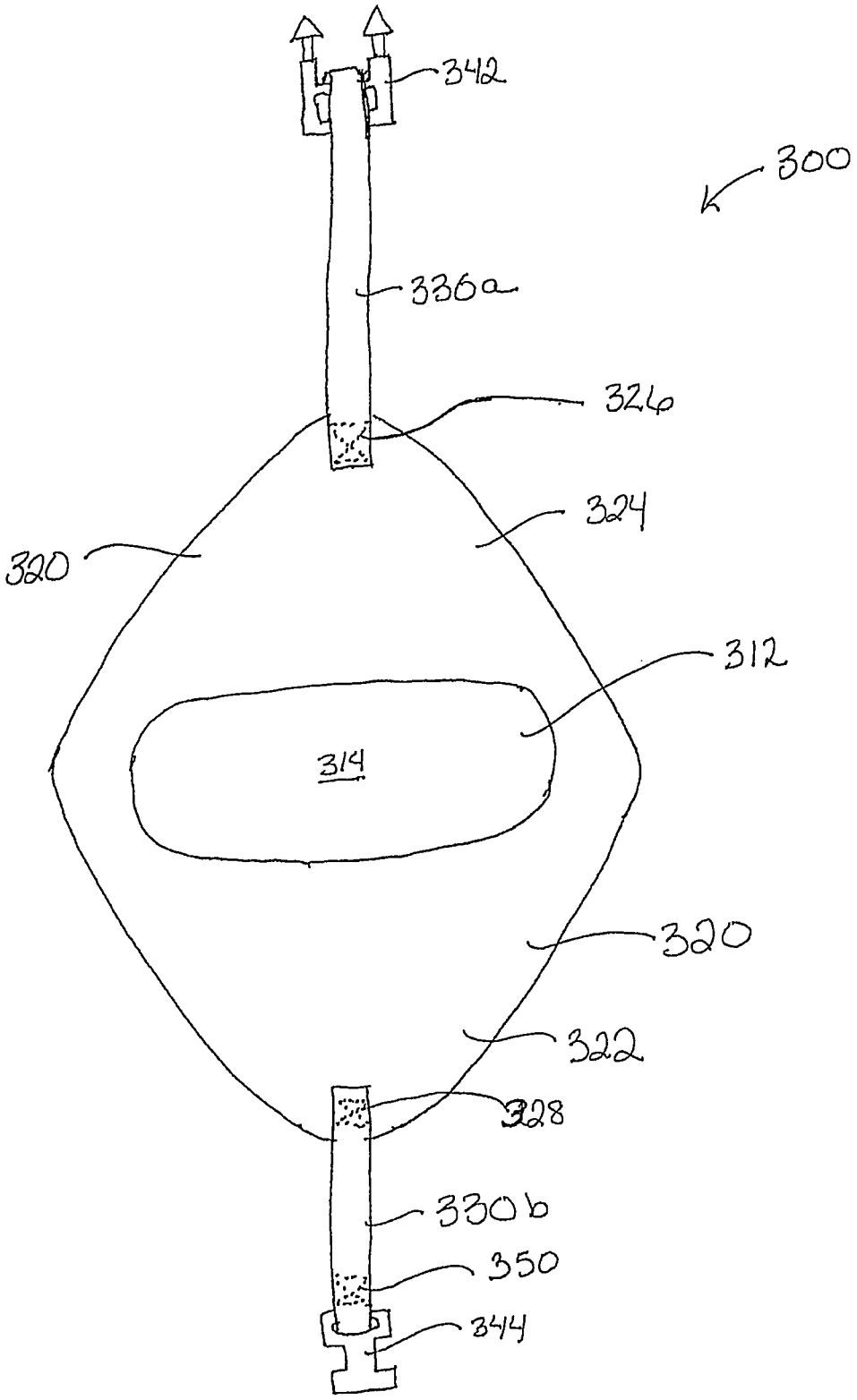
FIG. 16 is a bottom plan view of an inflatable backrest according to another embodiment.

Referring to FIG. 16, an embodiment of an inflatable backrest 300 that includes an inflatable body 312 that includes a base 314, an apron 320 attached to the body 312, a first strap 330*a* attached to a male connector 342 and fixedly attached to the underside of a back facing portion 324 of the apron 320 through stitching 326, and a second strap 330*b* fixedly attached to a female connector 344 through stitching 350 and to the underside of a front facing portion 322 of the apron 320 through stitching 328, as seen from the bottom (i.e., underside) of the backrest 300, is shown. The straps 330*a*, 330*b* are of a length sufficient to enable the male 342 and female 344 connectors to connect with each other and to extend around the circumference of a floatable recreational device such as an inner tube.

Although the strap has been described as including a securing strap 36 for securing the free end of the strap in a fixed position, in some embodiments, the strap does not include a fixing strap (i.e., a securing strap).

Figure 4:
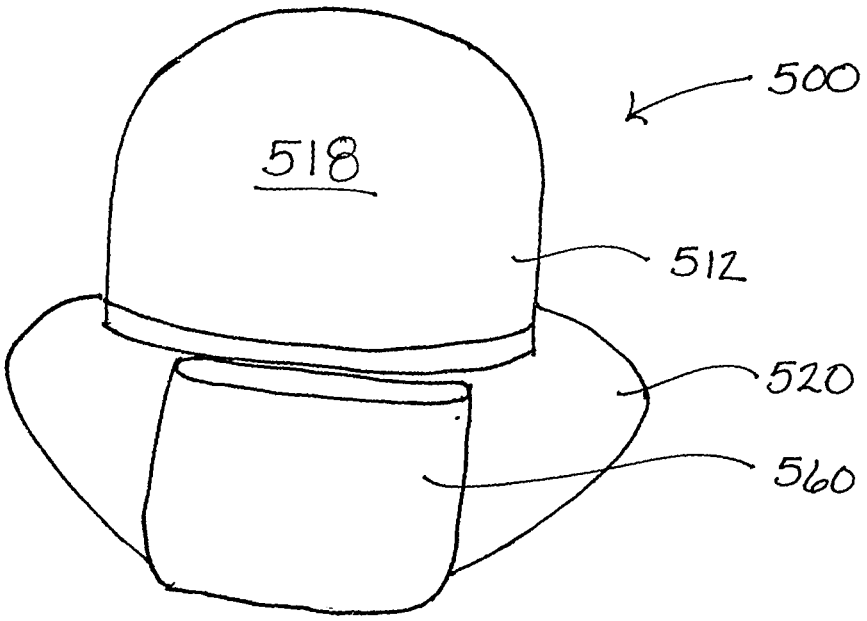
FIG. 4 is a back plan view of another embodiment of the inflatable backrest.
Figure 5:
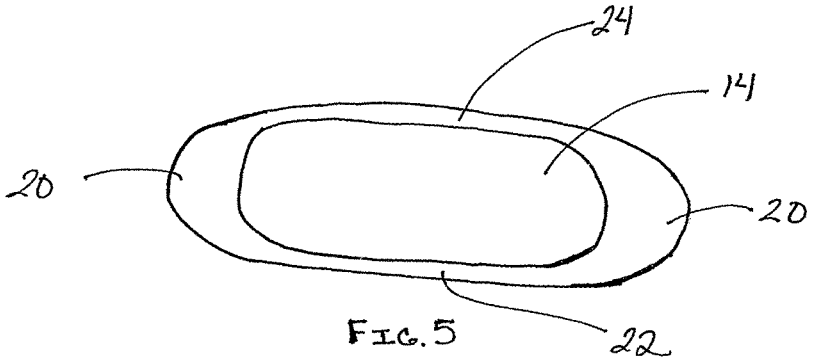
FIG. 5 is a bottom plan view of the inflatable backrest of FIG. 1 with the front facing and back facing portions of the apron folded against the sides of the body of the inflatable backrest.
Figure 6:
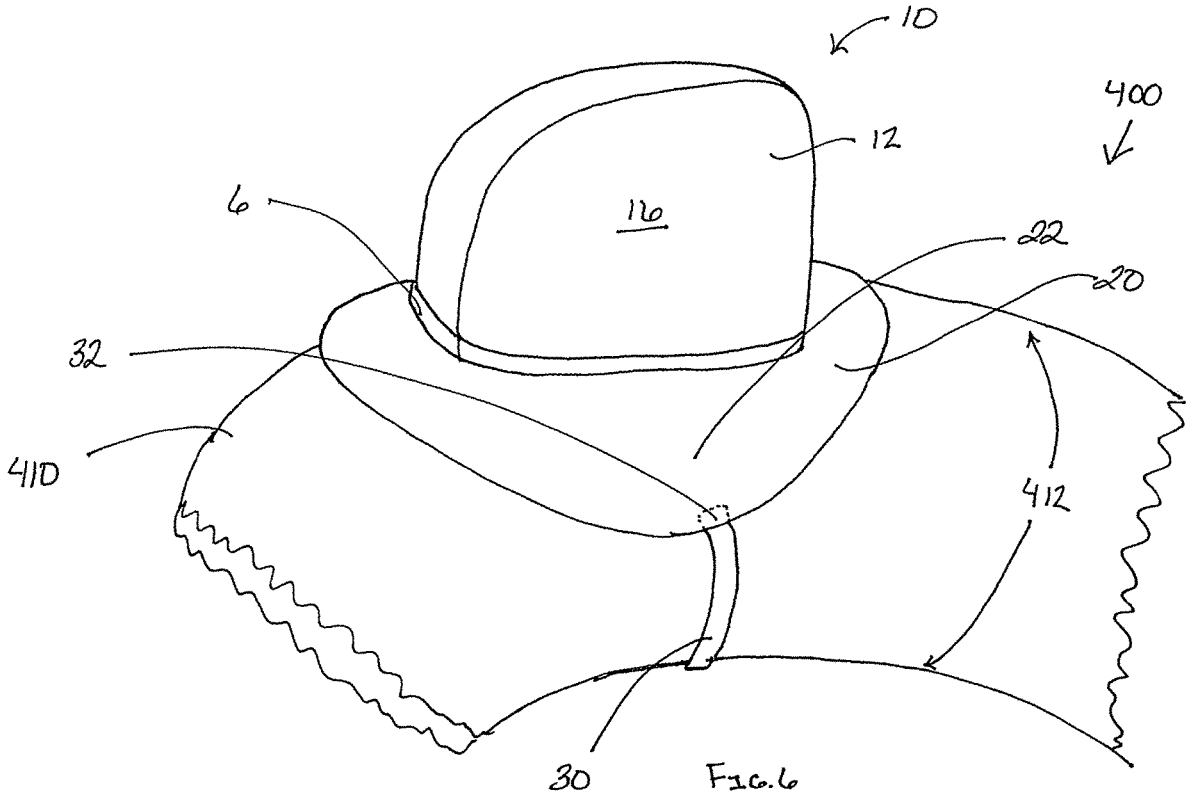
FIG. 6 is a perspective view of the inflatable backrest of FIG. 1 secured in position on an inner tube.
Figure 7:
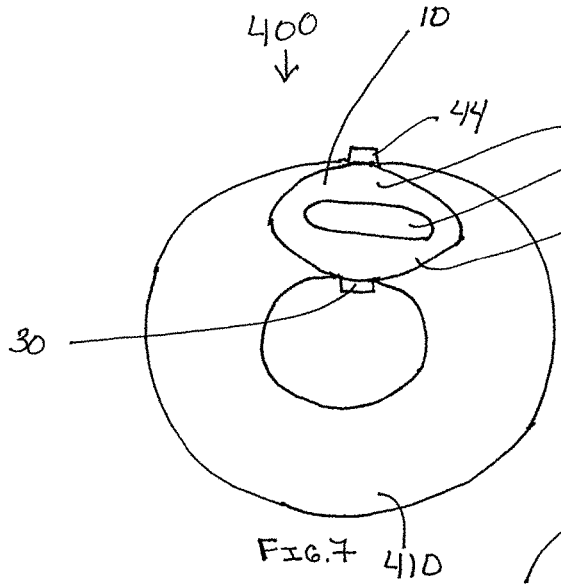
FIG. 7 is a top plan view of the inflatable backrest of FIG. 1 secured in position on an inner tube.
Figure 8:
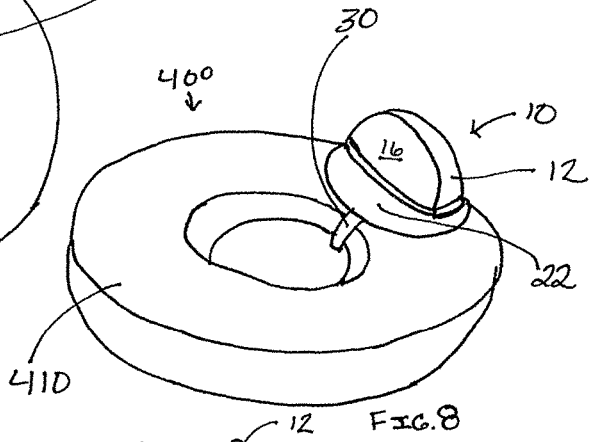
FIG. 8 is a perspective view of view of the inflatable backrest of FIG. 1 secured in position on an inner tube of FIG. 7.
Figure 9:
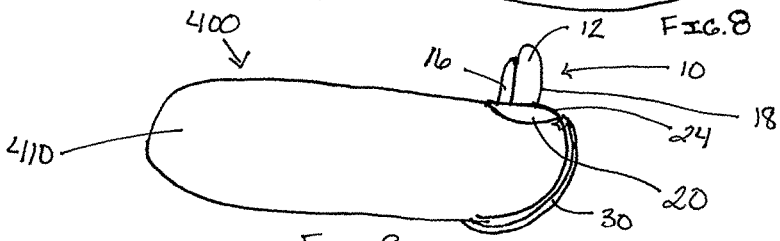
FIG. 9 is a right side view of the inflatable backrest of FIG. 1 secured in position on an inner tube of FIG. 7.
Figure 11:
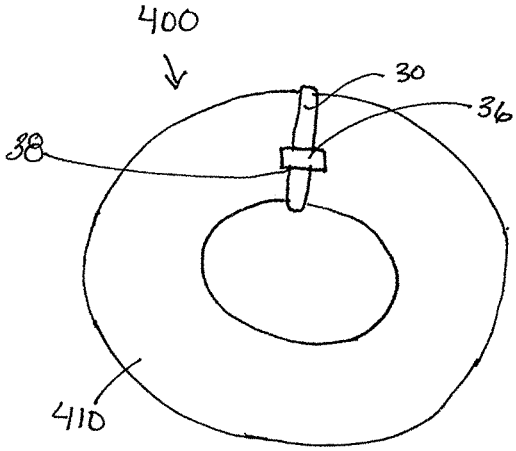
FIG. 11 is a bottom view of the inflatable backrest of FIG. 1 secured in position on an inner tube of FIG. 7.
Figure 10:
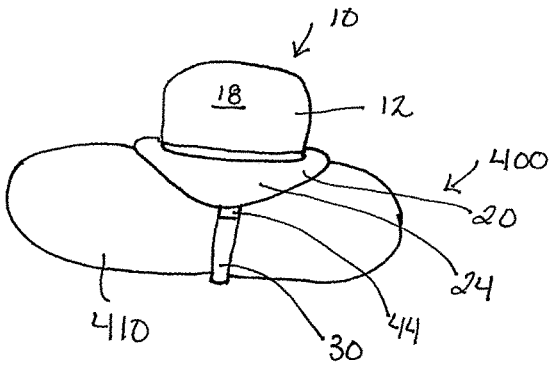
FIG. 10 is a back side view of the inflatable backrest of FIG. 1 secured in position on an inner tube of FIG. 7.

FIG. 4 illustrates an embodiment of the backrest 500 that includes a body 512, an apron 520, and a pouch 560 (e.g., a pouch made from loose netting) attached to the apron 520 for storing the body 512, apron 520, and strap(s) (not shown) of the backrest 500 when the body 512 is in a deflated state. In other embodiments, the pouch 560 is attached to the inflatable body 512 of the backrest 500, or both the apron 520 and the inflatable body 512 of the backrest 500.

Other embodiments are within the claims.

What is claimed is:

1. A removable inflatable backrest comprising:

an inflatable backrest comprising an inflatable body comprising a base, a front side extending from the base and having a first major front facing surface, and a back side opposite the front side, the back side extending from the base and having a second major back facing surface;

an apron fixedly attached to the inflatable backrest, the apron extending away from the first major front facing surface of the inflatable backrest and extending away from the second major back facing surface of the inflatable backrest; and a first strap attached to the apron, the first strap having a first end attached to the apron and a second end.

2. The removable inflatable backrest of claim 1 further comprising a mating connector comprising a female connector component and a male connector component, one of the male connector component and the female connector component coupled to the first strap, and the other of the male connector component and the female connector component coupled to the first strap, the apron, or a combination thereof.

3. The removable inflatable backrest of claim 2, wherein one of the male connector component and the female connector component is moveable relative to the strap, and the other of the male connector component and the female connector component is fixedly attached to the first strap, the apron, or a combination thereof.

4. The removable inflatable backrest of claim 2, wherein one of the male connector component and the female connector component is moveably coupled to the first strap, and the other of the male connector component and the female connector component is fixedly attached to the apron.

5. The removable inflatable backrest of claim 1, wherein the first strap comprises rubber selected from the group consisting of butyl rubber, halogenated butyl rubber, and combinations thereof.

6. The removable inflatable backrest of claim 1, wherein the first strap comprises thermoplastic polymer, elastomer, rubber, polymer-impregnated woven webs, multiple layers, or a combination thereof.

7. The removable inflatable backrest of claim 1, wherein the first strap comprises polyvinyl impregnated woven web, polyurethane impregnated woven web, thermoplastic resin-impregnated woven web, elastomer-impregnated woven web, rubber-impregnated woven web, or a combination thereof.

8. The removable inflatable backrest of claim 1, wherein the first end of the first strap is fixedly attached to the apron.

9. The removable inflatable backrest of claim 1, wherein the apron is fixedly attached to the inflatable backrest near the base of the inflatable body.

10. The removable inflatable backrest of claim 1, wherein the apron defines a shape selected from the group consisting of an arcuate shape, a linear shape, a v shape, and combinations thereof.

11. The removable inflatable backrest of claim 1, wherein the first strap has a longitudinal extent and a securing strap fixedly attached to the second end of the first strap, the securing strap having a longitudinal extent oriented perpendicular to the longitudinal extent of the first strap.

12. The removable inflatable backrest of claim 11, wherein the securing strap comprises a rubber selected from the group consisting of butyl rubber, halogenated butyl rubber, and combinations thereof.

13. The removable inflatable backrest of claim 1 further comprising a pouch attached to at least one of the inflatable body and the apron.

14. The removable inflatable backrest of claim 13, wherein the pouch is attached to the second major back facing surface of the inflatable backrest.

15. The removable inflatable backrest of claim 13, wherein the pouch is dimensioned to store the inflatable body when the inflatable body is in a deflated state.

16. The removable inflatable backrest of claim 1 further comprising a second strap, the first strap being fixedly attached to a portion of the apron extending from the first major front facing surface of the inflatable backrest and the second strap being fixedly attached to a portion of the apron extending from the second major back facing surface of the inflatable backrest.

17. An inflatable recreational device comprising:

a toroidal-shaped tube defining an interior hole and having a tube diameter; and a backrest secured to the tube, the backrest comprising an inflatable body of an inflatable backrest, the inflatable body comprising a base, a first major front facing surface and a second major back facing surface, an apron fixedly attached to the inflatable body, the apron extending away from the major front facing surface of the inflatable body and extending away from the second major back facing surface of the inflatable body; and a strap attached to at least one of the base of the inflatable body and the apron, the strap having a first end and a second end, the strap extending around the tube diameter and being fastened to the at least one of the base of the inflatable body and the apron and securing the inflatable backrest to the tube.

18. The inflatable recreational device of claim 17, wherein the toroidal-shaped tube comprises a rubber inner tube.

19. The inflatable recreational device of claim 17, wherein the toroidal-shaped tube comprises a rubber ring torus.

20. An inflatable backrest comprising:

an inflatable body of an inflatable backrest, the inflatable body comprising a base, a first major front facing surface and a second major back facing surface;

an apron fixedly attached to the inflatable body, the apron extending away from the major front facing surface of the inflatable body and extending away from the second major back facing surface of the inflatable body;

a first strap fixedly attached to a portion of the apron that extends from the first major front facing surface of the inflatable body, the first strap having a first end and a second end; and a second strap fixedly attached to a portion of the apron extending from the second major back facing surface of the inflatable body.

21. The removable inflatable backrest of claim 1 further comprising:

a first male-female connector comprising a first male connector component and a first female connector component, one of the first male connector component and first female connector component being fixedly attached to a portion of the apron that extends away from the first major front facing surface of the inflatable backrest and the other of the first male connector component and first female connector component being fixedly attached to a portion of the apron that extends away from the second major back facing surface of the inflatable backrest;

a second male-female connector comprising a second male connector component and a second female connector component, at least one of the second male connector component and the second female connector component coupled to the first end of the first strap, and the other of the second male connector component and the second female connector component coupled to the second end of the first strap, the first strap being attached to the apron through one of the first male connector component and first female connector component, and a mating one of the second male connector component and second female connector component.

* * * * *